US006325027B1

(12) United States Patent
Henriksen

(10) Patent No.: US 6,325,027 B1
(45) Date of Patent: Dec. 4, 2001

(54) BEARING ARRANGEMENT

(75) Inventor: Leif Dag Henriksen, Skein (NO)

(73) Assignee: Sinus Holding AS, Breivik (NO)

( * ) Notice: Subject to any disclaimer, the term of this patent is extended or adjusted under 35 U.S.C. 154(b) by 0 days.

(21) Appl. No.: 09/421,997

(22) Filed: Oct. 20, 1999

Related U.S. Application Data

(62) Division of application No. 09/319,034, filed on May 28, 1999.

(51) Int. Cl.[7] ..... F02B 75/18

(52) U.S. Cl. ..... 123/53.6; 123/56.2; 123/56.9; 384/49

(58) Field of Search ..... 123/53.6, 56.1, 123/56.2, 53.1, 53.3, 53.4, 53.5, 56.9; 384/32, 49, 50, 51, 441

(56) References Cited

U.S. PATENT DOCUMENTS

| | | | | |
|---|---|---|---|---|
| 1,895,206 | * | 1/1933 | Ricardo | 123/53.6 |
| 2,647,363 | * | 8/1953 | Stott | 123/56.9 |
| 3,337,278 | * | 8/1967 | Vigh | 384/491 |
| 3,574,425 | * | 4/1971 | Johnson et al. | 384/491 |
| 3,599,307 | * | 8/1971 | Campbell et al. | 29/898.069 |
| 3,772,750 | * | 11/1973 | Hauser | 29/899.1 |
| 5,031,581 | * | 7/1991 | Powell | 123/51 B |
| 5,222,814 | * | 6/1993 | Boelryk | 384/47 |
| 5,362,156 | * | 11/1994 | Hara | 384/45 |
| 5,375,567 | * | 12/1994 | Lowi, Jr. | 123/56.8 |
| 5,417,496 | * | 5/1995 | Hobbs | 384/18 |
| 5,517,953 | * | 5/1996 | Wiesen | 123/51 R |
| 5,716,139 | * | 2/1998 | Okamoto et al. | 384/45 |
| 5,737,971 | * | 4/1998 | Riefe et al. | 74/493 |
| 6,098,578 | * | 8/2000 | Schuko | 123/56 |

FOREIGN PATENT DOCUMENTS

| | | | | |
|---|---|---|---|---|
| 280880 | * | 10/1994 | (JP) | F16C/33/32 |

* cited by examiner

*Primary Examiner*—Willis R. Wolfe
*Assistant Examiner*—Hai Huynh
(74) *Attorney, Agent, or Firm*—Francis C. Hand, Esq.; Carella, Byrne et al

(57) ABSTRACT

The bearing arrangement includes an annular flange provided with a groove, a holder disposed on a fixed axis opposite the groove and a hollow shell-shaped sphere mounted between the holder and the groove in the annular flange. The sphere is elastically deformable so that loads imposed on the bearing arrangement, for example, by a reciprocating piston rod of an internal combustion engine, can be spread over a large area as the sphere elastically deforms.

14 Claims, 5 Drawing Sheets

BEARING ARRANGEMENT

This application is a division of pending U.S. application Ser. No. 09/319,034, filed May 28, 1999.

This invention relates to a bearing arrangement. More particularly, this invention relates to a bearing arrangement for a piston rod in an internal combustion engine.

Heretofore, various types of bearing arrangements have been known for transferring forces, between two or more relatively movable components. For example, as described in pending patent application Ser. No. 09/319,035, motion between a reciprocating piston rod and a rotating annular cam guide device is transferred by the use of a ball bearing mounted on the end of the piston rod and rolling relative to a track on the rotating guide device.

Typically, a ball bearing is constructed with balls or rollers of solid construction which are able to roll between the inner and outer races of a radial bearing or between two annular rings of a thrust bearing or between two tracks or a linear bearing. In general, and especially in extreme cases, each bearing ball or roller is supported solely through a point or a rather restricted support area due to the high rigidity of the bearing ball or roller combined with a correspondingly high rigidity of the bearing race or support track.

During the transfer of a high pressure load and/or with rapid reciprocating movements of the bearing ball, a significant wear and tear occurs on the bearing ball or roller. In addition, the support surfaces are also subjected to a high wear and tear. Consequently, over a period of time, either the bearing ball/roller or the bearing race/ring or both are gradually worn down or deformed with a result that the bearing has a reduced life.

Typically, wear and tear is due mainly to a rapid repeated high local load imposed upon the bearing ball combined with a restricted load transfer area between the bearing ball and the support surface.

Additional problems are also caused by extreme loads combined with extreme bearing ball velocities and extreme gravity forces provided by the solid and compact bearing ball. This is particularly present in ball bearings which are moved in reciprocating movements in high speed engines.

In practical use, for example, when exposed to regularly occurring extreme pressure loads combined with extreme velocities, each bearing ball as well as the associated support surface is vulnerable and has accordingly been manufactured of a solid, rather shape-stable and non-elastic material. Accordingly, the bearing ball, raceway and ring or similar support surface has been made of a material such as steel, other suitable metal or similar solid material which is resistant to high loads and wear and tear. However, such solid and rather non-elastic materials cause wear and tear especially of the support track and the associated holder.

In a specific employment, for example, when employing a ball bearing to transfer loads to a reciprocating piston rod moving at extreme velocities, i.e. at high speed, the reciprocating movements in a longitudinal direction of the piston rod combined with high speed rolling/revolving movements of the bearing balls, produces gravitational forces in the balls which rise to corresponding extreme values. This also imparts extreme loads on and extensive wear and tear of the associated support surface.

Accordingly, it is an object of the invention to reduce the wear and tear of a bearing arrangement.

It is another object of the invention to utilize low weight spheres in a ball bearing arrangement.

It is another object of the invention to reduce gravity forces and extreme loading in a bearing arrangement without reducing the durability of the bearing arrangement.

It is another object of the invention to provide for an enlarged support area between a pressure sphere and an opposed support surface of a bearing arrangement in order to transfer a load over an enlarged support area.

It is another object of the invention to provide for a locally restricted elastic deformation of a bearing member in a bearing arrangement for a reciprocating piston rod of an engine.

Briefly, the invention provides a bearing arrangement comprising a track, a hollow-shaped sphere mounted on the track for relative movement thereto and a holder opposite the track and having the sphere rotatably held therein. In one embodiment, the holder is disposed on a fixed axis while the track is movable relative to the holder. For example, the track may be of annular shape and may be rotatable about an axis parallel to the fixed axis of the holder. In another embodiment, the track may be stationary while the holder is movable along the track. In either embodiment, the track is provided with a groove for receiving the sphere.

In accordance with the invention, the bearing sphere is elastically deformable under a compressive force which is applied between the track and the holder.

In an embodiment which employs a rotatable annular flange having an annular groove to receive the hollow-shell shaped sphere, the annular flange may be part of a cam guide device for driving a piston rod in a reciprocating manner in a cylinder of an internal combustion engine. In addition, the groove in the annular flange may have a curved contour to effect reciprocation of the piston as the flange rotates.

One new result of employing the bearing arrangement is that the pressure load on the pressure sphere, in general, is considerably reduced. This is due to a considerable reduction of the sphere mass and, accordingly, the sphere weight and its occurring gravitational forces. This result is especially of particular importance in cases where high or extreme velocities are involved, e.g. in connection with use of the bearing arrangement with a reciprocating piston rod which is exposed to high speed reciprocating movement velocities combined with high sphere rolling velocity. In the latter case, a considerable reduction of gravitational forces acting on the sphere is achieved, due to a corresponding reduction of its mass and weight. The total pressure sphere load is accordingly considerably reduced.

The hollow shell-shaped pressure sphere is provided with a relatively thin wall thickness which enables an elastic deformation of at least a local sphere surface portion supported against the sphere holder and/or the sphere track. The use of a thin walled shell-shaped pressure sphere allows an intentional local elastic deformation of the pressure sphere without reducing the total strength of the pressure sphere.

The resulting enlarged support area between the pressure sphere and its support surface causes a reduced pressure to act between the pressure sphere and its opposed support surface and results in reduced local wear and tear.

In a specific employment, when employed at the outer end of an axially reciprocating piston rod acting against a guide cam in a piston-cylinder arrangement, such as described in the parent application, the bearing arrangement is advantageous in that a pair of pressure spheres are located at opposite sides of an intermediate annular support flange and the flange is provided with a groove or track at opposite sides for individual support of either pressure sphere. The result is that the pressure load involved in two opposite axial directions in the piston rod may be transferred in a controlled and secure manner centrally thereof, as the case may be, through either of the opposed pressure spheres at opposite sides of the intermediate annular support flange, i.e. in mutually opposite directions.

In normal operation, a first one of the pressure spheres is in direct contact with its support track, whereas the second one may be out of support track contact and without pressure load. This effect may be caused by employment of elastically deformable pressure spheres. As soon as it is required, i.e. when a load occurs in an opposed direction, the latter load can momentarily be transferred through the second pressure sphere while allowing an unloading effect on the first pressure sphere.

This effect is of special importance in cases where each of the sphere tracks is contoured as a sine-like curve. This means that one of the pressure spheres is maintained out of contact with its sine-like curved track when a specific pressure is acting on the other one of the pressure spheres between its sphere holder and its sine-like curved, track and vice versa.

This effect is in practice efficiently controlled by the possible local elastic deformation of the activated pressure sphere. Accordingly, when a momentary peak load occurs, a compressed and deformed pressure sphere, firstly, provides for an advantageous dampening effect to occur in the pressure sphere and, secondly, provides for an enlarged support area.

The present invention is illustrated herein with specific reference to an embodiment wherein the bearing arrangement is arranged on a piston rod head which is exposed to extreme loads combined with extreme movement velocities. The advantages obtained are especially significant for the illustrated embodiment.

However, the bearing arrangement is additionally of great importance also for different other employments, e.g. when exposed to moderate loads and/or moderate velocities. The advantages obtained in the latter cases are also of great practical importance.

The bearing arrangement is also useful in different types of ball bearings, such as a radial or thrust ball bearing having an annular ring with a plurality of bearing balls therein and, alternatively, in a ball bearing having a single bearing ball therein.

These and other objects and advantages of the invention will become more apparent from the following description taken in conjunction with the accompanying drawings wherein:

FIG. 1 illustrates a vertical sectional view through an internal combustion engine in which a bearing arrangement in accordance with the invention may be employed;

FIG. 2 schematically illustrates a general pattern of movement for one of the two pistons associated with each cylinder of a three cylinder engine in accordance with FIG. 1;

Figure 1:
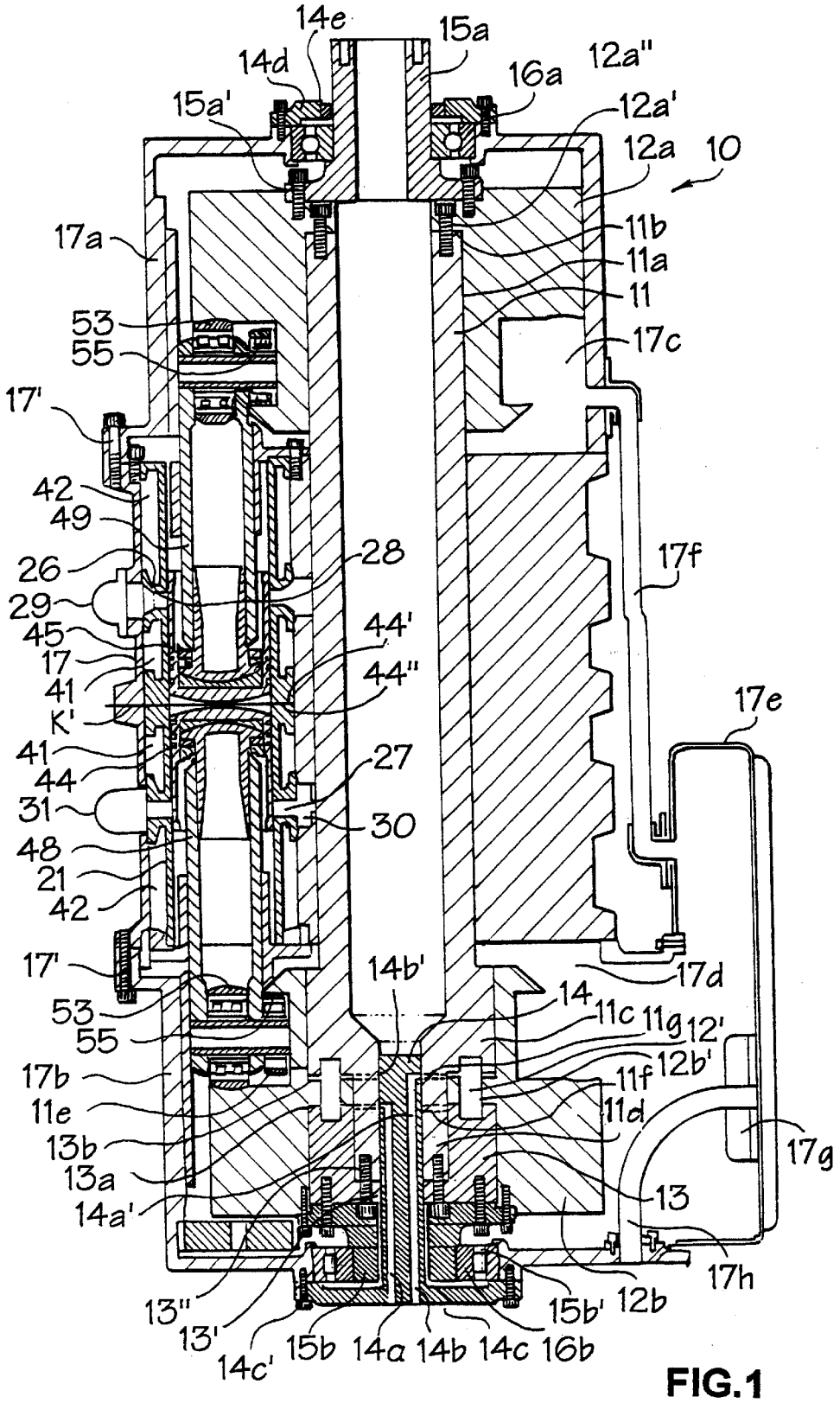

Referring to FIG. 1, the internal combustion engine 10 is specifically described in copending application Ser. No. 09/319,035 and a further description is not believed to be necessary herein. As illustrated, the internal combustion engine 10 has a drive shaft 11 disposed on a central axis and passing through an engine block 17 in which a plurality of cylinders are disposed about the drive shaft 11. Each cylinder contains two reciprocating pistons 44, 45 which are disposed in opposition to each other about a working chamber K' and each is connected to a piston rod 48, 49.

Each piston rod 48, 49 carries a ball bearing or caster 53 at one end which rolls on a curved cam surface of a cam guide device 12*a,* 12*b*.

The curved cam surface of each cam guide device 12*a,* 12*b* is contoured to form a "sine" curve as is particularly described in the parent application noted above.

Generally, the "sine" concept can be applied with an odd number (1, 3, 5, etc) of cylinders, with an even number (2, 4, 6, etc.) of "sine"-planes being employed and vice versa.

In a case where a single sine plane (having a sine on top and a sine on the bottom) is employed in each of the cam guide devices 12*a* and 12*b,* that is to say, the sine plane covers an angular arc of 360°, it is immaterial whether an odd number or even number of cylinders is employed. Correspondingly, with a number of two (or more) sine planes, there can for instance be employed a larger or smaller number of cylinders as required.

The case with a single sine plane can be especially of interest for use in rapidly running engines which are driven at speeds over 2000 rpm.

According to the sine concept, the individual engine can be "internally" geared with respect to speed, all according to which number of sine-tops and sine-bottoms is to be employed at each 360° revolution of the drive shaft. In other words, both engines can be built precisely in the revolutions per minute region which is relevant for the individual application.

Generally, the series arranged cylinders of the engine, with associated pistons, of the illustrated embodiment are arranged in specific angular positions around the axis of the drive shaft, for instance with mutually equal intermediate spaces along the sine plane or along the series of sine planes (the sine curve).

For example, for a two cycle or four cycle engine numbering three cylinders (see FIG. 2), there can be employed for each 360° revolution, two sine tops (crests) and two sine bottoms (troughs) and four oblique surfaces lying between, that is to say, two sine planes are arranged after each other in each cam guide device 12*a,* 12*b*. Consequently, in a four cycle motor, four cycles can be obtained for each of the two pistons of the three cylinders with each revolution of the drive shaft/cam guide devices and four cycles for each of the two pistons of the three cylinders in a two cycle engine. Correspondingly, for a two cycle engine numbering five cylinders, there can be employed, for each 360° revolution, a sine curve with two sine tops (crests) and two sine bottoms (troughs) and four oblique surfaces lying between, that is to say, two sine planes arranged after each other in each cam guide device 12*a,* 12*b,* so that in a two cycle engine, four cycles are obtained for each of the two pistons of the five cylinders with each revolution.

The support rollers of the pistons are placed in the illustrated embodiment with equivalently equal angular intermediate spaces, that is to say in equivalent rotary angular positions along the sine curve, so that they are subjected one after the other to equivalent piston movements in equivalent positions along the respective sine planes.

Figure 2:
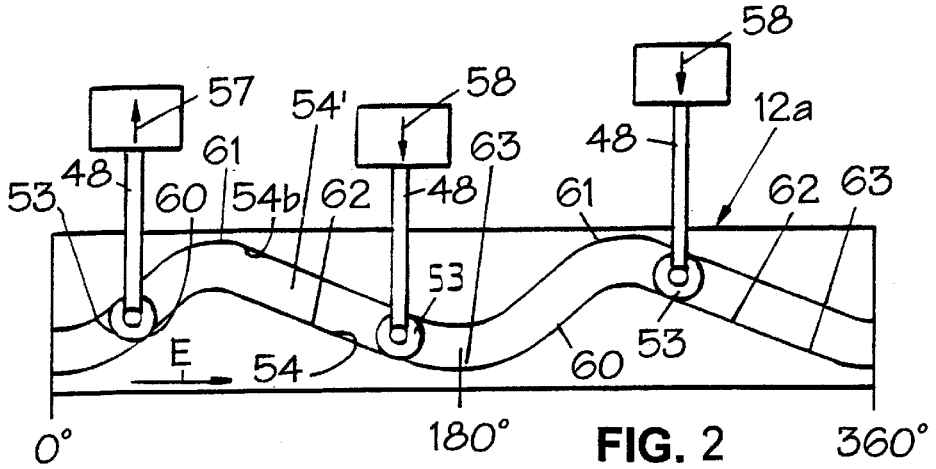
Figure 3:
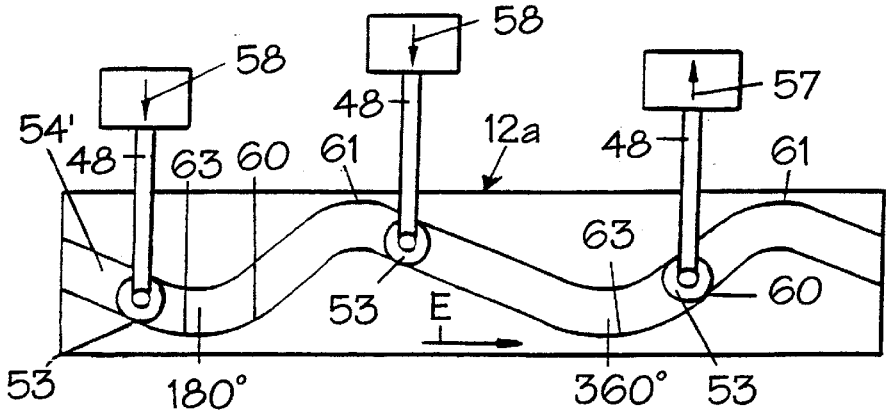
FIG. 3 illustrates a view similar to FIG. 2 at a later point in time of an engine cycle.
Figure 4:
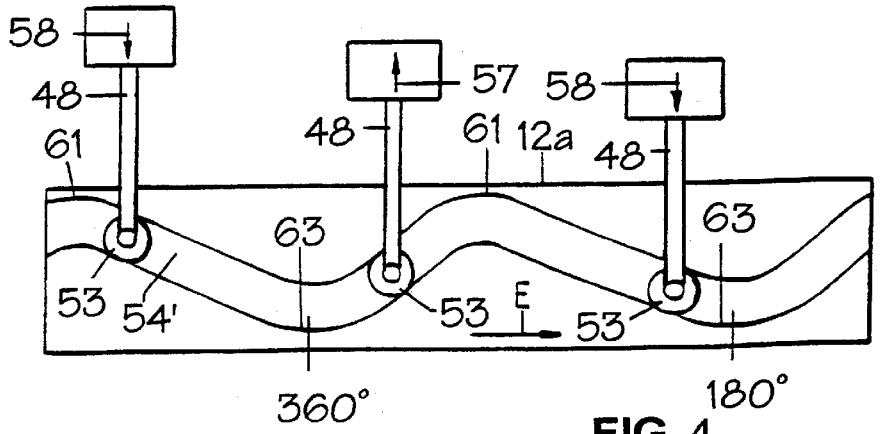
FIG. 4 illustrates a view similar to FIGS. 2 and 3 at a still later point in time of an engine cycle.

FIG. 2 schematically shows the mode of operation of a three cylinder engine 10 in which one piston 44 is shown of the two cooperating pistons 44, 45, illustrated in a planar spread condition along an associated sine curve 54' which consists of two mutually succeeding sine planes, plus the associated main caster 53 of the associated one piston rod 48. FIGS. 2, 3 and 4 schematically show the associated one piston 44 in each of three cylinders 21 of the engine, an equivalent arrangement being employed for the piston 45 at the opposite end of the cylinders. For the sake of clarity, the cylinder 21 and the opposite piston 45 have been omitted from FIGS. 2 to 4, only the piston 44, its piston rod 48 and its main caster 53 being shown. Axial movements of the piston 44 are illustrated by an arrow 57, which marks the compression stroke of the piston 44, and an arrow 58, which marks the expansion stroke of the piston 44.

The sine curve 54' is shown with a lower roll path 54, which has a double sine plane-shaped contour and which generally guides the movement of the main caster 53 in an axial direction, in that it more or less constantly effects a downwardly directed force from the piston 44 via the main caster 53 towards the roll path 54 in the expansion stroke and an upwardly directed force from the roll path 54 via the main caster 53 towards the piston 44 in the compression stroke. The auxiliary caster 55 (not shown) is received with a sure fit relative to an upper roll path 54*b*. For illustrative reasons, the roll path 56*b* is shown vertically above the main caster 53 in FIGS. 2 to 4, so as to indicate the maximum movement of the main caster 53 axially relative to its roll path 54.

The auxiliary caster 55 is normally not active, but will control movement of the piston 44 in an axial direction in the instances the main caster 53 has a tendency to raise itself from the cam-forming roll path 54. During operation, lifting of the main caster 53 in an unintentional manner relative to the roll path 54 can be hereby be avoided. The roll path 56 for the auxiliary caster 55 is normally arranged in the fixed fit spacing from the associated roll path 56*a*.

In FIGS. 2 to 4, the sine curve 54' is shown with a first relatively steep and relatively rectilinear running curve portion 60 and a subsequent, more or less arcuate, top-forming transition portion/dead portion 61 and a second relatively more gently extending, relatively rectilinearly running curved portion 62 and a subsequent arcuate transition portion/dead portion 63. These curve contours are, however, not representative in detail of the curve contours which are employed.

The sine curve 54' and the sine plane 54 are shown in FIGS. 2 to 4 with two tops 61 and two bottoms 63 and two pairs of curve portions 60, 62. Three pistons 44 and their respective main caster 53 are shown in equivalent positions along an associated sine curve in mutually different, succeeding positions. It is evident from the drawing that the relatively short first curve portion 60 entails that at all times only one main caster 53 will be found on the one short curve portion and two or roughly two main casters 53 on the two longer curve portions 62. In other words, with the illustrated curve contour, different forms of curve portions can be employed for the compression stroke relative to the form of the curve options for the expansion stroke. Inter alia, one can hereby ensure that the two main casters 53 at all times overlap the expansion stroke, while the third main caster 53 forms the part of the compression stroke. In practice, movement of the piston 44 is achieved with relatively greater speeds of movement in the axial direction in the compression stroke than in the expansion stroke. In themselves, these different speeds of movement do not have a negative influence on the rotational movement of the drive shaft 11. On the contrary, vibration-inducing movements in the engine can be eliminated, with such an unsymmetrical design of the curve portions 60, 62 relative to each other.

Further, there is obtained an increase of the time which is relatively placed for disposition in the expansion stroke relative to the time which is reserved for the compression stroke.

In a practical construction according to FIGS. 2 to 4, there is chosen in a 180° working sequence, an arc length for the expansion stroke of about 105° and an equivalent arc length for the compression stroke of about 75°. But actual arc lengths can for instance lie between 110° and 95° when the expansion stroke is concerned and equivalently between 70° and 85° when the compression stroke is concerned.

For instance, a set of three cylinders 21 associated with three pairs of pistons 44, 45, as is described above, two tops 61 and two bottoms 63 are employed for each 360° revolution of the drive shaft 11, that is to say, two expansion strokes per piston pair 44, 45 per revolution.

In use, the four pairs of pistons can be correspondingly employed with three tops and three bottoms, that is to say, three expansion strokes per piston pair per revolution.

Figure 5:
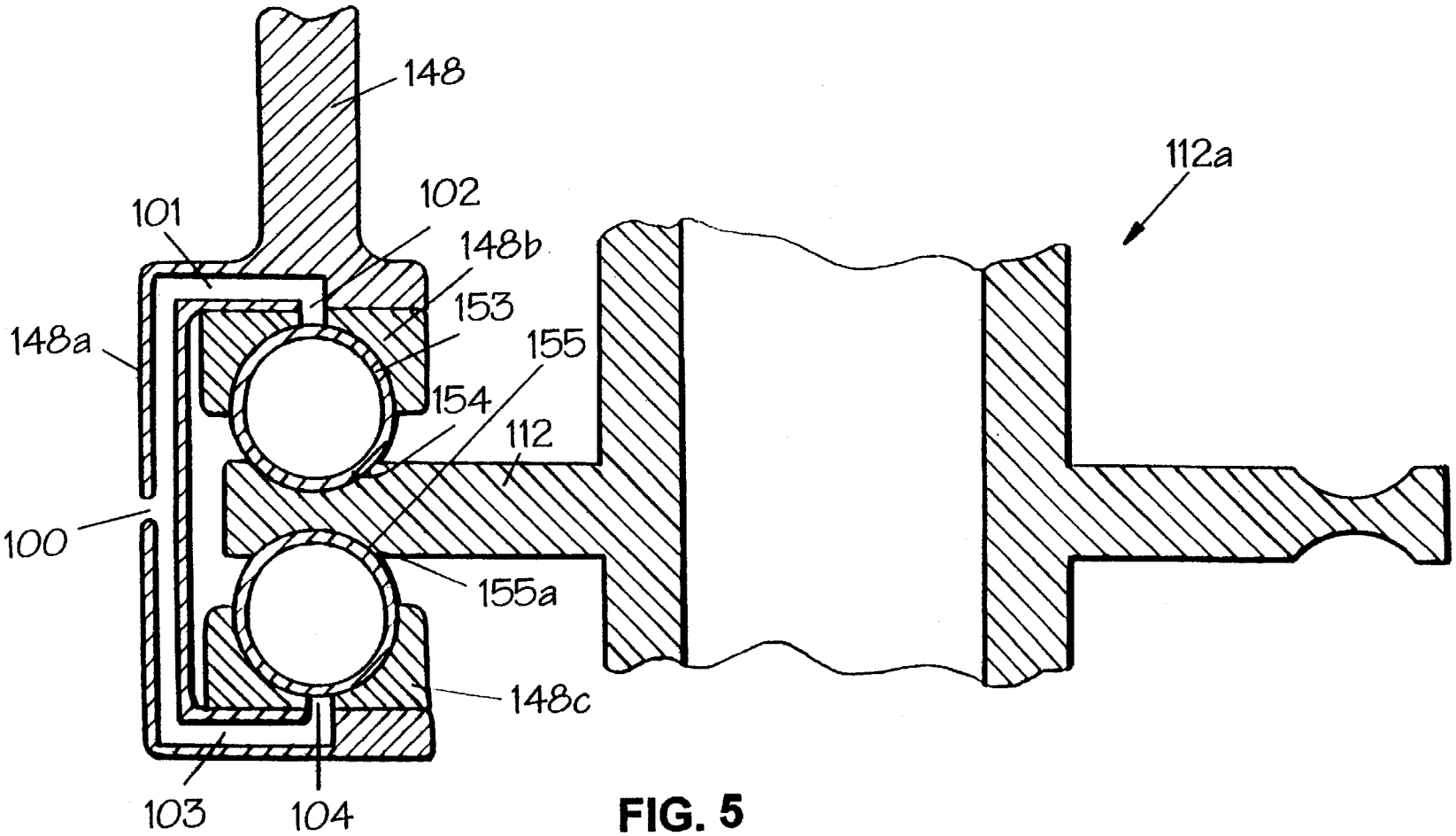
FIG. 5 illustrates a cross sectional view of a bearing arrangement in accordance with the invention in conjunction with a piston rod of an engine as in FIG. 1.

FIG. 5 illustrates an embodiment in accordance with the invention using a modified bearing arrangement including a modified cam guide device 112*a* and employing a pair of pressure spheres (i.e. hollow shell-shape bearing elements) 153, 155.

In the construction according to FIG. 1, the cam guide device 12*a* is shown having a relatively space-demanding design with associated casters 53 and 55 arranged at the side of each other in the radial direction of the cam guide device 12*a*, that is to say, with the one caster 53 arranged radially outside the remaining caster 55 and with the associated sine grooves 54, 55*c* illustrated correspondingly radially separated on each of their radial projections.

In the embodiment of FIG. 5, the pressure spheres 153, 155 are arranged in succession in the axial direction of the cam guide device 112*a*, that is to say, with a sphere on each respective side of an individual dual, common projection, illustrated in the form of an intermediate annular flange 112. The annular flange 112 is shown with an upper sine curve forming sine groove 154 for guiding the upper pressure sphere 153, which forms the main support sphere of the piston rod 148, and a lower sine curve forming sine groove 155*a* for guiding a lower pressure sphere 155, which forms the auxiliary support sphere of the piston rod 148. The annular grooves 154, 155*a* have, as shown in FIG. 5, a laterally concavely rounded form corresponding to the spherical contour of the spheres 153, 155. The annular flange 112 is shown having a relatively small thickness, but the small thickness can be compensated for as to strength in that the annular flange 112 has a self-reinforcing sine curve contour in the peripheral direction, such as indicated by the obliquely extending section of the annular flange illustrated in FIG. 1.

Figure 6:
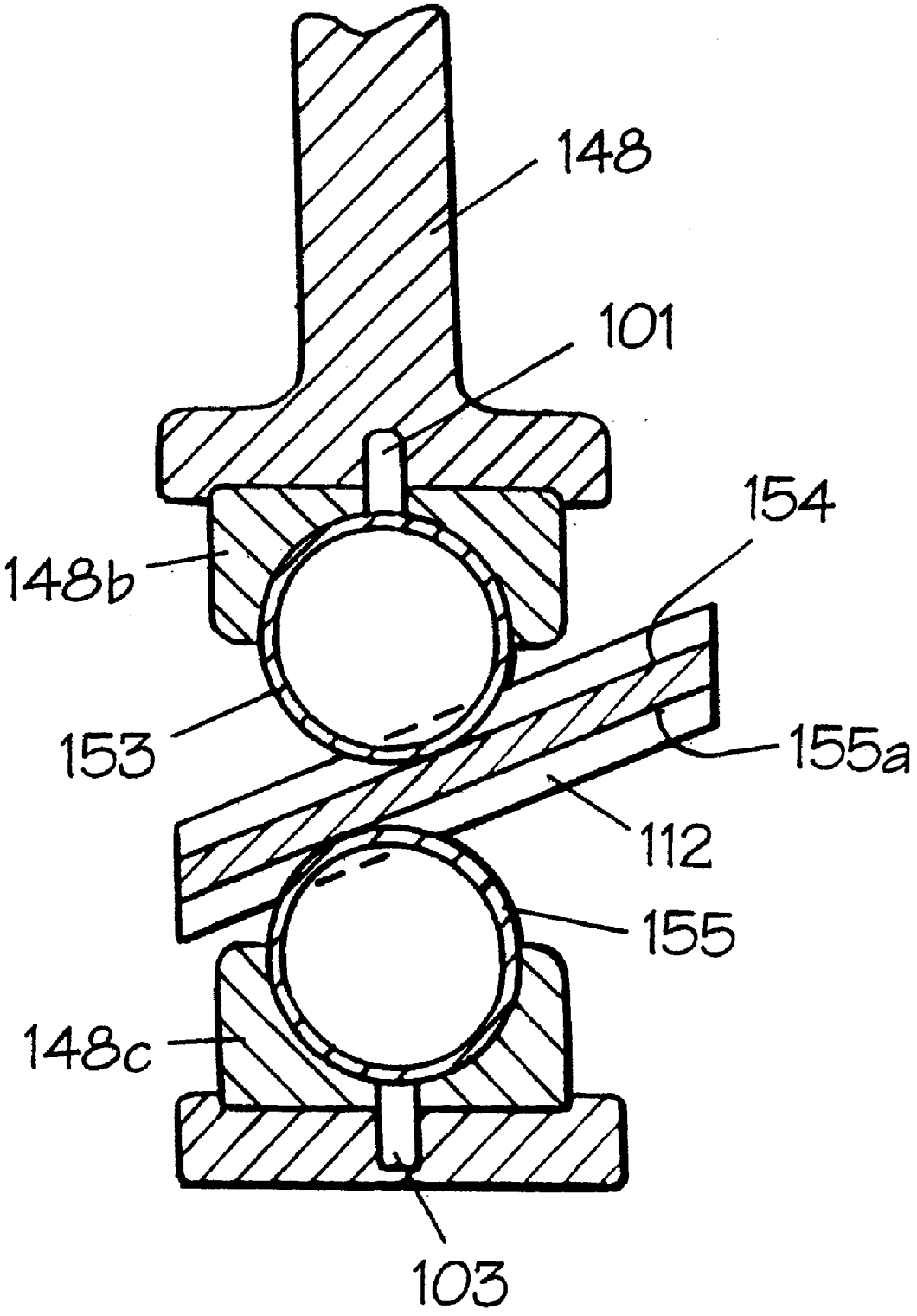
FIG. 6 illustrates a modified bearing arrangement in accordance with the invention.

In FIG. 5, the annular flange 112 is shown segmentally in section, while in FIG. 6, a peripherally locally defined segment of the annular flange 112 is shown in cross-section as viewed from the inner side of the annular flange 112.

A largely corresponding design of the afore-mentioned details may be used in both cam guide devices of a cylinder.

According to FIG. 1, a pipe-shaped, relatively voluminous piston rod 48 is shown, while in the alternative embodiment according to FIG. 5, a slimmer, compact, rod-shaped piston rod 148 is employed having a C-shaped head portion 148*a* with two mutually opposite sphere holders 148*b*, 148*c* for a respective pressure sphere 153, 155.

The piston rod 148 may be provided with external screw threads (not shown) which cooperate with internal screw threads in the head portion, so that the piston rod 148 and thereby the associated sphere holder 148*b* can be adjusted into desired axial positions relative to the head portion 148*a*. This can, inter alia, facilitate the mounting of the sphere holder 148*b* and its associated sphere 153 relative to the annular flange 112.

In FIG. 6, the annular flange 112 is shown with a minimum thickness at obliquely extending portions of the annular flange, while the annular flange 112 can have a greater thickness at the peaks and valleys of the sine curve, so that a uniform or largely uniform distance can be ensured between the spheres 153, 155 along the whole periphery of the annular flange.

As shown in FIG. 5, a lubricating oil intake 100 is provided in the head portion 148*a* which branches off internally into a first duct 101 to a lubricating oil outlet 102 in the upper sphere holder 148*b* and into a second duct 103 to a lubricating oil outlet 104 in the lower sphere holder 148*c*.

Instead of the casters 53, 55 shown according to FIG. 1, which are mounted in ball bearings, pressure spheres 153, 155 are shown according to FIGS. 5 and 6. The pressure spheres 153, 155 are mainly adapted to be rolled relatively rectilinearly along the associated sine grooves 154, 155*a*, but can in addition be permitted to be rolled sideways to a certain degree in the respective groove as required. The spheres 153, 155 are designed identically, so that the sphere holders 148*a*, 148*b* and their associated sphere beds can also be designed mutually identically and so that the contoured grooves 154, 155*a* can also be designed mutually identically.

The pressure spheres 153, 155 are shown hollow and shell-shaped with a relatively thin wall thickness. Thus, the pressure spheres are of low weight. In addition, there is a certain elastically in each sphere for locally relieving extreme pressure forces which arise in the sphere per se.

Figure 7:
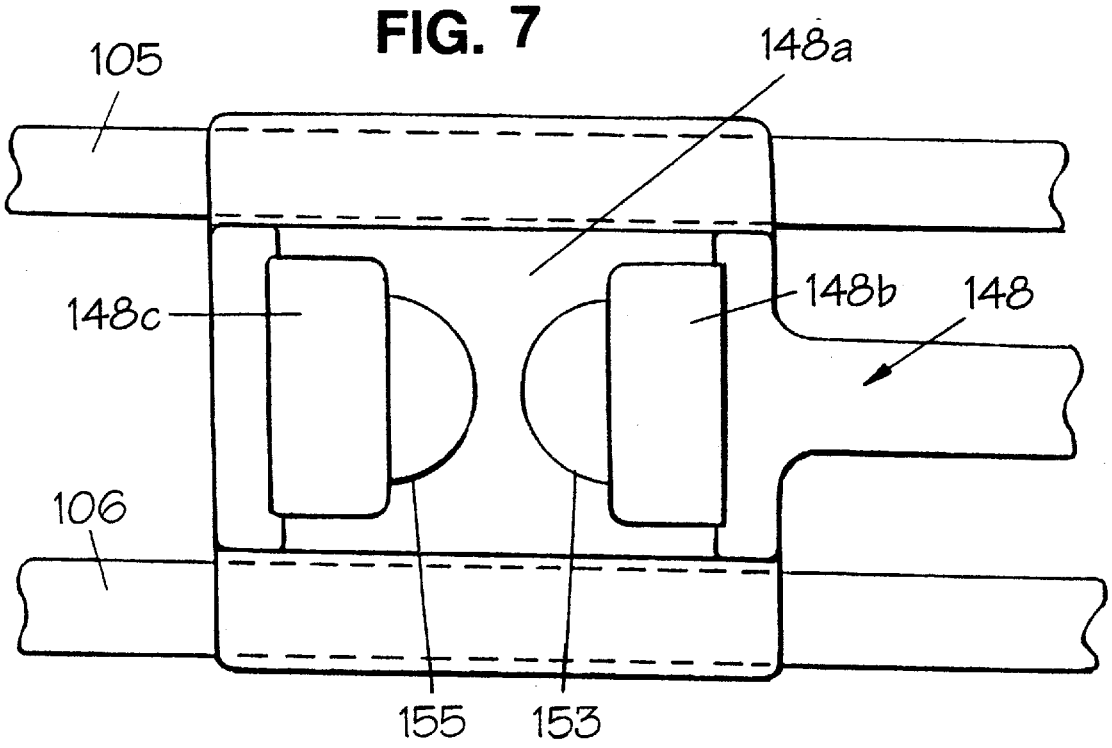
Fig. 7 illustrates a view of a guide arrangement for the piston rod of FIG. 5.
Figure 8:
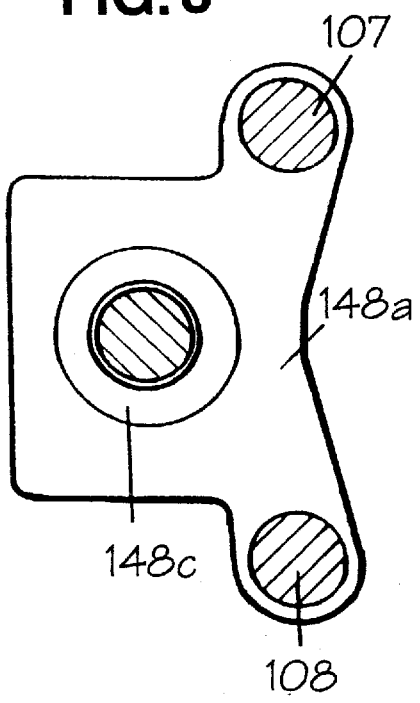
FIG. 8 illustrates a cross-sectional view of the guide arrangement for the piston rod of FIG. 7.

Referring to FIGS. 7 and 8, wherein like reference characters indicate like parts as above, the head portion 148*a* is slidably mounted on guide rods 105, 106 via internal guide bores 107, 108 in the head portion 148*a*.

The bearing arrangement may be employed in a conventional type of radial bearing in which as plurality of hollow shell-shaped spheres are disposed between two concentric rings or raceways as well as in a conventional thrust bearing wherein a plurality of hollow shell-shaped spheres are mounted between two annular plates. In either case, each sphere is elastically deformable under a compressive force applied between the rings or plates whereby each sphere deforms against the annular rings or plates to effect an enlarged contact surface therebetween.

Similarly, the bearing arrangement may be employed as a linear bearing in which a plurality of hollow shell-shaped spheres are mounted between two reciprocating tracks. In this case, the spheres are elastically deformable under a compressive force applied from one track to the other so that each sphere deforms against the respective tracks to effect an enlarged contact surface therebetween.

The invention thus provides a bearing arrangement which allows reduced wear and tear in the operation of the overall engine and particularly in the guiding of the reciprocating movements of the pistons of the engine relative to the cam guide devices.

Further, the invention allows a considerable reduction in the gravitational forces acting on the hollow shell-shaped spheres of the bearing arrangement particularly during high speed reciprocating movement velocities of the piston rods which are being guided. In this respect, the elasticity of the spheres allows deformation of the spheres so as to spread a load over an enlarged area rather than over a small point or points.

What is claimed is:

1. A bearing arrangement comprising a track;

a hollow shell-shaped sphere mounted on said track for relative movement thereto; and a holder opposite said track and having said sphere rotatably held therein wherein said sphere is elastically deformable under a compressive force applied between said track and said holder.

2. A bearing arrangement as set forth in claim 1 wherein said holder is disposed on a fixed axis and said track is movable relative to said holder.

3. A bearing arrangement as set forth in claim 2 wherein said track is annular and is rotatable about an axis parallel to said fixed axis.

4. A bearing arrangement as set forth in claim 3 wherein said annular track has an annular groove on one side receiving said sphere therein.

5. A bearing arrangement comprising a rotatable annular flange having a first annular groove on one side and a second annular groove on an opposite side, each said groove defining a sine-like cam surface;

a first holder disposed on a fixed axis opposite said first groove;

a second holder disposed on a fixed axis opposite said second groove;

a first hollow shell-shaped sphere mounted in said first holder and in contact with said first groove; and a second hollow shell-shaped sphere mounted in said second holder and in contact with said second groove wherein each said sphere is elastically deformable whereby elastic deformation of one of said spheres relative to said flange allows said flange to move away from the other of said spheres.

6. A bearing arrangement as set forth in claim 5 which further comprises an outlet in each said holder for passing lubricating oil to and between each said holder and a respective sphere therein.

7. A bearing arrangement as set forth in claim 5 wherein each said holder is disposed on a common axis.

8. In combination a reciprocally mounted piston rod for movement on a fixed axis;

a pair of holders fixedly mounted relative to said position rod for movement therewith;

a pair of hollow shell-shaped spheres, each sphere being rotatably mounted in a respective one of said holders; and an annular flange rotatably mounted about a second axis parallel to said fixed axis and disposed between said spheres, said flange having a first annular groove receiving one of said spheres therein and a second annular groove receiving the other of said spheres therein wherein each said groove defines a sine-like curved cam surface and wherein each said sphere is elastically deformable whereby elastic deformation of one of said spheres relative to said flange allows said flange to move away from the other of said spheres.

9. The combination as set forth in claim 8 which further comprises an outlet in each said holder for passing lubricating oil to and between each said holder and a respective sphere therein.

10. The combination as set forth in claim 8 further comprising a pair of parallel guide rods and wherein said piston rod has a head portion slidably guided on said rods.

11. A radial bearing comprising:

an annular ring; and a plurality of hollow shell-shaped spheres rollably mounted on said ring, each said sphere being elastically deformable under a compressive force applied thereto whereby each said sphere deforms against said annular ring to effect an enlarged contact surface therebetween.

12. A bearing as set forth in claim 11 further comprising a second annular ring concentric to said first annular ring and having said spheres disposed therebetween.

13. A thrust bearing comprising a pair of relatively rotatable plates disposed on a common axis of rotation; and a plurality of hollow shell-shaped spheres rollably mounted on and between said plates, each said sphere being elastically deformable under a compressive force applied between said plates whereby each said sphere deforms against each said plate to effect an enlarged contact surface therebetween.

14. A linear bearing comprising a pair of parallel relatively movable tracks; and a pair of relatively rotatable tracks disposed on a common axis of rotation; and a plurality of hollow shell-shaped spheres rollably mounted on and between said tracks, each said sphere being elastically deformable under a compressive force applied between said tracks whereby each said sphere deforms against each said plate to effect an enlarged contact surface therebetween.

* * * * *